US006033841A

United States Patent [19]

Bell et al.

[11] Patent Number: 6,033,841

[45] Date of Patent: Mar. 7, 2000

[54] COLOUR PHOTOGRAPHIC SILVER HALIDE MATERIAL

[75] Inventors: Peter Bell, Köln; Hans-Ulrich Borst, Elsdorf; Ralf Büscher, Lohmar; Jörg Siegel; Rainer Scheerer, both of Köln; Heinz Schütz, Leverkusen, all of Germany

[73] Assignee: AGFA-Gevaert NV, Belgium

[21] Appl. No.: 09/036,220

[22] Filed: Mar. 6, 1998

[30] Foreign Application Priority Data

Mar. 14, 1997 [DE] Germany ..... 197 10 611

[51] Int. Cl.[7] ..... G03C 1/46

[52] U.S. Cl. ..... 430/504; 430/506; 430/507; 430/509; 430/510; 430/517; 430/552; 430/553; 430/555

[58] Field of Search ..... 430/504, 506, 430/507, 509, 510, 517, 552, 553, 555

[56] References Cited

U.S. PATENT DOCUMENTS 2,350,380 6/1944 White ..... 95/2
4,186,011 1/1980 Lohmann et al. ..... 430/506
4,857,448 8/1989 Simons ..... 430/506

FOREIGN PATENT DOCUMENTS 727 702 2/1996 European Pat. Off. .
285 206 U 10/1983 Germany .

*Primary Examiner*—Geraldine Letscher
*Attorney, Agent, or Firm*—Connolly, Bove, Lodge& Hutz LLP

[57] ABSTRACT

A color photographic silver halide material having at least two red-sensitive, cyan-coupling silver halide emulsion layers of different photographic sensitivity, at least two green-sensitive, magenta-coupling silver halide emulsion layers of different photographic sensitivity and at least one blue-sensitive, yellow-coupling silver halide emulsion layer, and having intermediate layers at least between silver halide emulsion layers of different color sensitivity, wherein at least one color coupler is provided in an intermediate layer which is directly adjacent to a lowest-sensitivity silver halide emulsion layer which is sensitive to a defined spectral region and which couples to the complementary color, which color coupler couples in a non-complementary manner with respect to the aforementioned lowest-sensitivity silver halide emulsion layer, is distinguished by its improved reproduction of yellow color shades.

11 Claims, No Drawings

COLOUR PHOTOGRAPHIC SILVER HALIDE MATERIAL

This invention relates to a colour photographic silver halide material having at least two red-sensitive, cyan-coupling silver halide emulsion layers of different photographic sensitivity, at least two green-sensitive, magenta-coupling silver halide emulsion layers of different photographic sensitivity and at least one blue-sensitive, yellow-coupling silver halide emulsion layer, and having intermediate layers at least between silver halide emulsion layers of different colour sensitivity.

It is known, from U.S. Pat. No. 2,350,380, DD 285 206 and EP 727 702 for example, that colour couplers can be incorporated in layers which are free from silver halide, wherein situating these layers directly adjacent to silver halide emulsion layers is preferably avoided, however, in order to avoid sensitising the silver halide thereof in a manner which is not complementary to the colour of the dye which is formed from said coupler.

It has now surprisingly been found that a colour photographic silver halide emulsion material of the type cited at the outset, which is characterised in that at least one colour coupler is provided in an intermediate layer which is directly adjacent to a lowest-sensitivity silver halide emulsion layer which is sensitive to a defined spectral region and which couples to the complementary colour, which colour coupler couples in a non-complementary manner with respect to the aforementioned lowest-sensitivity silver halide emulsion layer, is distinguished by an improved reproduction of yellow colour shades (e.g. lemon yellow) without an increase in yellow fogging when stored in the dark and without impairment of the colour reproduction of the other colours.

In one preferred embodiment of the invention, the silver halide-free layer which is directly adjacent to the highest-sensitivity red-sensitive layer and which is directly adjacent to the lowest-sensitivity green-sensitive layer contains at least one cyan coupler.

In another preferred embodiment, a silver halide-free layer which is directly adjacent to the highest-sensitivity green-sensitive layer and which is directly adjacent to the lowest-sensitivity blue-sensitive layer contains at least one magenta coupler.

The cyan coupler of the intermediate layer can be different to the cyan coupler or couplers of the red-sensitive layers; it is preferably identical to the cyan coupler or to one of the cyan couplers of the highest sensitivity red-sensitive layer.

The same applies, correspondingly, to the magenta coupler.

The couplers are preferably used in the intermediate layers in an amount from $10^{-5}$ to $5.10^{-4}$ mmoles/$m^2$.

Naphtholic cyan couplers and 2-equivalent pyrazolone magenta couplers are preferred.

Other preferred embodiments of the invention are given in the subsidiary claims.

The preferred yellow filter dyes correspond to formulae (I) and (II):

(I)

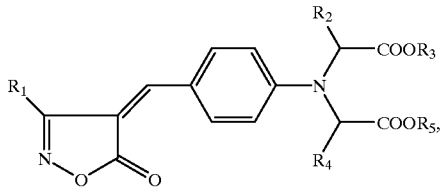

(II)

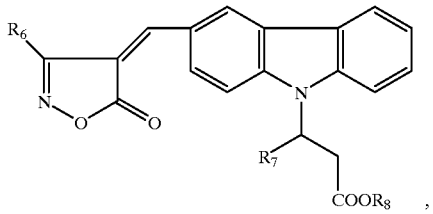

wherein $R_1$, $R_3$, $R_5$, $R_6$ and $R_8$, independently of each other, represent alkyl, cycloalkyl or aryl, and $R_2$, $R_4$ and $R_7$, independently of each other, represent hydrogen or alkyl.

Examples of alkyl groups represented by $R_1$ to $R_7$ include methyl, ethyl, propyl, isopropyl, isobutyl, tert.-butyl or neopentyl. Said alkyl groups may be unsubstituted or may be substituted by a halogen such as fluorine, chlorine or bromine, an alkoxy such as methoxy, ethoxy, propoxy, isopropoxy, isobutoxy, tert.-butoxy, neo-pentoxy, ethoxyethoxy or isobutoxyethoxy, a sulphamoyl such as N-tolylsulphonamido or N-(1)-naphthylsulphamoyl, or an aryl such as phenyl, alkoxyphenyl, alkylsulphonamidophenyl, N-alkylsulphamoylphenyl or acylaminophenyl.

The dyes according to the invention may contain solubilising groupings which comprise a dissociable proton, e.g. —NH—$SO_2$— (sulphamido or sulphamoyl) —CO—NH—CO—, —CO—NH—$SO_2$— or —$SO_2$NH—$SO_2$—.

Dyes of formulae (I) and (II) are described in DE 196 46 402.

Examples of colour photographic materials include colour negative films, colour reversal films, colour positive films, colour photographic paper, colour reversal photographic paper, and colour-sensitive materials for the colour diffusion transfer process or for the silver colour-bleaching process. The invention is preferably employed for colour negative films.

The photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285.

Colour negative films comprise, in the following sequence on their support: 2 or 3 red-sensitive, cyan-coupling silver halide emulsion layers, 2 or 3 green-sensitive, magenta-coupling silver halide emulsion layers, and 2 or 3 blue-sensitive, yellow-coupling silver halide emulsion layers. The layers of identical spectral sensitivity differ as regards their photographic sensitivity, wherein the less sensitive partial layers are generally disposed nearer the support than are the more highly sensitive partial layers.

A yellow filter layer is usually provided between the green-sensitive and blue-sensitive layers, and prevents blue light from reaching the layers underneath.

The options for different layer arrangements and their effects on photographic properties are described in J. Inf. Rec. Mats., 1994, Vol. 22, pages 183–193.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE-25 30 645).

The essential constituents of the photographic emulsion layer are the binder, the silver halide grains and colour couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 37254, Part 3 (1995), page 286, and in Research Disclosure 37038, Part XV (1995), page 89.

Colour photographic materials which exhibit camera-sensitivity usually contain silver bromide-iodide emulsions, which may also optionally contain small proportions of silver chloride.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, and in Research Disclosure 37038, Part XIV (1995), page 86.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, optical brighteners, spacers, filter dyes, formalin scavengers, light stabilisers, antioxidants, $D_{min}$ dyes, additives for improving dye-, coupler- and whiteness-stability and for reducing colour fogging, plasticisers (latices), biocides and other substances.

Suitable compounds are described in Research Disclosure 37254, Part 8 (1995), page 292, and in Research Disclosure 37038, Parts IV, V, VI, VII, X, XI and XIII (1995), page 84 et seq.

The layers of colour photographic material are usually hardened, i.e. the binder which is used, preferably gelatine, is crosslinked by suitable chemical methods.

Suitable hardener substances are described in Research Disclosure 37254, Part 9 (1995), page 294, and in Research Disclosure 37038, Part XII (1995), page 86.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95 et seq., together with examples of materials.

EXAMPLE 1

A colour photographic recording material for the development of a colour negative (sample 1.1-comparative) was produced by depositing the following layers, in the given sequence, on a transparent film base of cellulose triacetate 120 $\mu$m thick, which was provided with an adhesive layer. The amounts are given in g/m$^2$. The corresponding amounts of $AgNO_3$ are given for the silver halide deposition. All the silver halide emulsions were stabilised with 0.1 g 4-hydroxy-6-methyl-1,3,3a,7-tetraazaindene per 100 g $AgNO_3$. The silver halide emulsions were characterised by the halide composition and, with regard to their grain size, by the volumetric datum point (VDP or $d_v$). The volumetric datum point has the dimensions of length [$\mu$m] and is determined via the relationship $$VSP = \bar{d}_V = \frac{\sum n_i d_i^4}{\sum n_i d_i^3}$$

where $n_i$ denotes the number of particles within the interval i and $d_i$ denotes the diameter of the spheres of identical volume for the particles within the interval i.

Sample 1.1

| Layer 1: (anti-halo layer) | |
|---|---|
| dye F-1 | 0.12 |
| dye F-2 | 0.12 |
| gelatine | 0.8 |

-continued

| | |
|---|---|
| Layer 2: (low-sensitivity red-sensitised layer) | |
| red-sensitised silver bromide-iodide-chloride emulsion (2.4 mole % iodide, 10.5 mole % chloride; VDP 0.35) | 0.85 |
| gelatine | 0.6 |
| cyan coupler C-1 | 0.3 |
| chromatic coupler CR-1 | $2.0 \times 10^{-2}$ |
| chromatic coupler CY-1 | $1.0 \times 10^{-2}$ |
| DIR coupler DIR-1 | $1.0 \times 10^{-2}$ |
| Layer 3: (medium-sensitivity red-sensitised layer) | |
| red-sensitised silver bromide-iodide emulsion (10.0 mole % iodide; VDP 0.56) | 1.2 |
| gelatine | 0.9 |
| cyan coupler C-1 | 0.2 |
| chromatic coupler CR-1 | $7.0 \times 10^{-2}$ |
| chromatic coupler CY-1 | $3.0 \times 10^{-2}$ |
| DIR coupler DIR-1 | $4.0 \times 10^{-3}$ |
| Layer 4: (high-sensitivity red-sensitised layer) | |
| red-sensitised silver bromide-iodide emulsion (6.8 mole % iodide; VDP 1.2) | 1.6 |
| gelatine | 1.2 |
| cyan coupler C-1 | 0.15 |
| DIR coupler DIR-3 | $3.0 \times 10^{-2}$ |
| Layer 5: (intermediate layer) | |
| dye F-3 | 0.12 |
| gelatine | 1.0 |
| Layer 6: (low-sensitivity green-sensitised layer) | |
| green-sensitised silver bromide-iodide-chloride emulsion (9.5 mole % iodide, 10.4 mole % chloride; VDP 0.5) | 0.85 |
| gelatine | 0.9 |
| magenta coupler M-1 | 0.3 |
| chromatic coupler MY-1 | $2.0 \times 10^{-2}$ |
| DIR coupler DIR-1 | $5.0 \times 10^{-3}$ |
| DIR coupler DIR-2 | $1.0 \times 10^{-3}$ |
| oxform scavenger SC-1 | $5.0 \times 10^{-2}$ |
| Layer 7: (medium-sensitivity green-sensitised layer) | |
| green-sensitised silver bromide-iodide emulsion (10.0 mol % iodide; VDP 0.56) | 1.4 |
| gelatine | 0.9 |
| magenta coupler M-1 | 0.24 |
| chromatic coupler MY-1 | $4.0 \times 10^{-2}$ |
| DIR coupler DIR-1 | $5.0 \times 10^{-3}$ |
| DIR coupler DIR-2 | $3.0 \times 10^{-3}$ |
| Layer 8: (high-sensitivity green-sensitised layer) | |
| green-sensitised silver bromide-iodide emulsion (6.8 mol % iodide; VDP 1.1) | 1.7 |
| gelatine | 1.2 |
| magenta coupler M-2 | $30 \times 10^{-2}$ |
| chromatic coupler MY-2 | $5.0 \times 10^{-2}$ |
| DIR coupler DIR-3 | $5.0 \times 10^{-2}$ |
| Layer 9: (yellow filter layer) | |
| yellow colloidal silver sol | 0.1 |
| gelatine | 0.8 |
| polyvinylpyrrolidone | 0.2 |
| oxform scavenger SC-2 | $6.0 \times 10^{-2}$ |
| Layer 10: (low-sensitivity blue-sensitised layer) | |
| blue-sensitised silver bromide-iodide chloride emulsion (6.0 mole % iodide; VDP 0.78) | 0.4 |
| gelatine | 1.0 |
| yellow coupler Y-1 | 0.4 |
| DIR coupler DIR-1 | $3.0 \times 10^{-2}$ |
| Layer 11: (medium-sensitivity blue-sensitised layer) | |
| blue-sensitised silver bromide-iodide emulsions (8.8 mole % iodide, 15.0 mole % chloride; VDP 0.77) | 1.2 |
| (12.0 mole % iodide, 15.0 mole % chloride; VDP 1.0) | 0.28 |
| gelatine | 0.77 |
| yellow coupler Y-1 | 0.58 |
| Layer 12: (high-sensitivity blue-sensitised layer) | |
| blue-sensitised silver bromide-iodide emulsion | 1.2 |

-continued
| | |
|---|---|
| (12.0 mole % iodide; VDP 1.2) | |
| gelatine | 0.9 |
| yellow coupler Y-1 | 0.1 |
| DIR coupler DIR-3 | $2.0 \times 10^{-2}$ |
| Layer 13: (protective layer) | |
| micrate-silver bromide-iodide emulsion | 0.25 |
| (4.0 mole % iodide; VDP 0.05) | |
| UV absorber UV-1 | 0.2 |
| UV absorber UV-2 | 0.3 |
| gelatine | 1.4 |
| Layer 14: (Hardening layer) | |
| gelatine | 0.2 |
| hardener H-1 | 0.86 |
| Persoftal | 0.04 |
Compounds used in Example 1
F-1
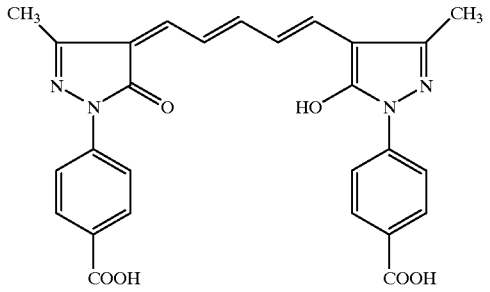
F-2
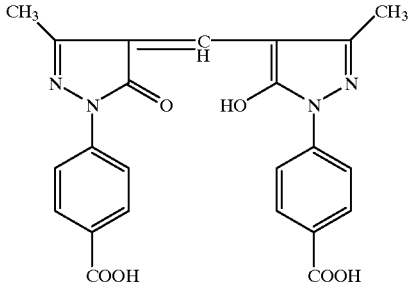
F-3
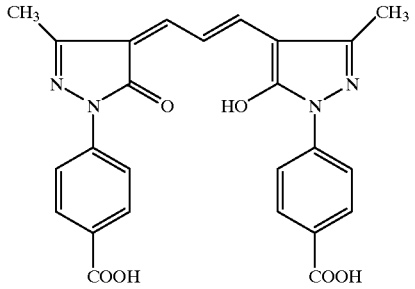

-continued
C-1
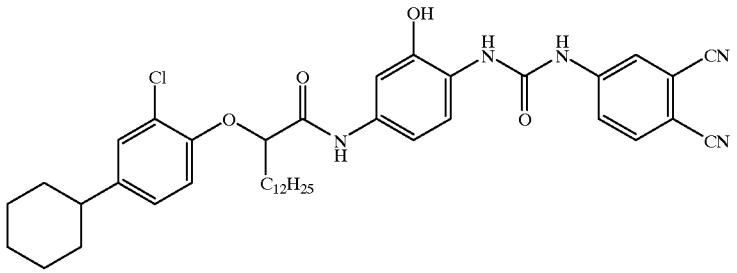
C-2
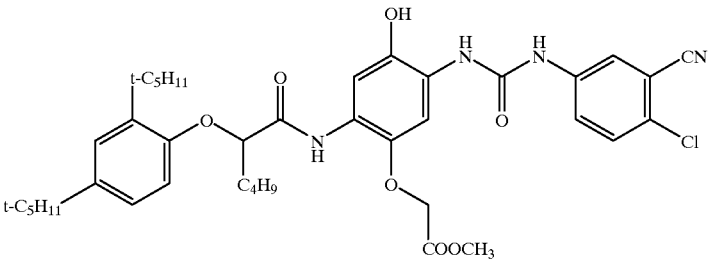
CR-1
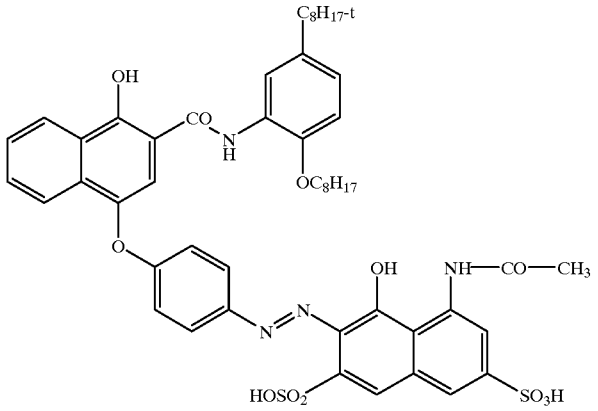
CY-1
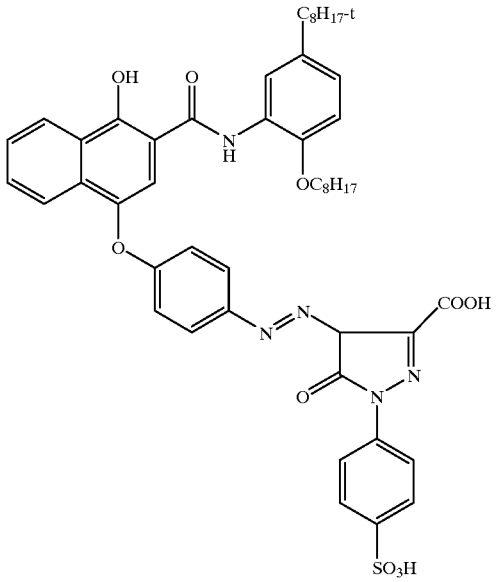

-continued
M-1
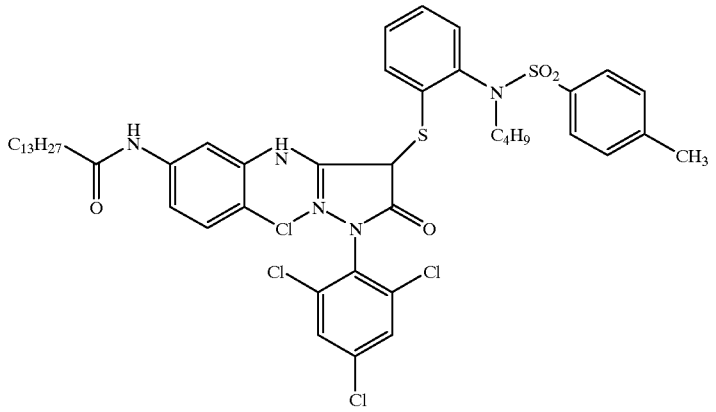
M-2
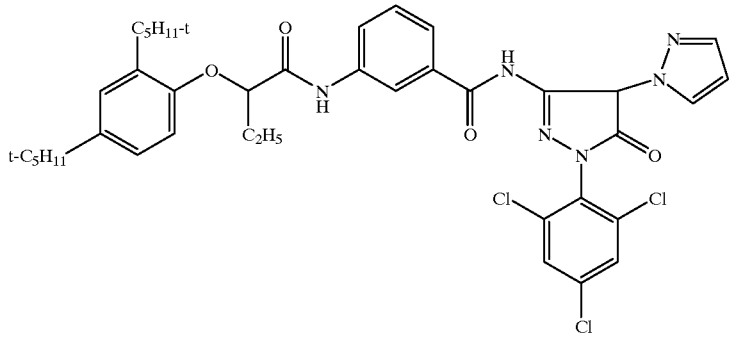
MY-1
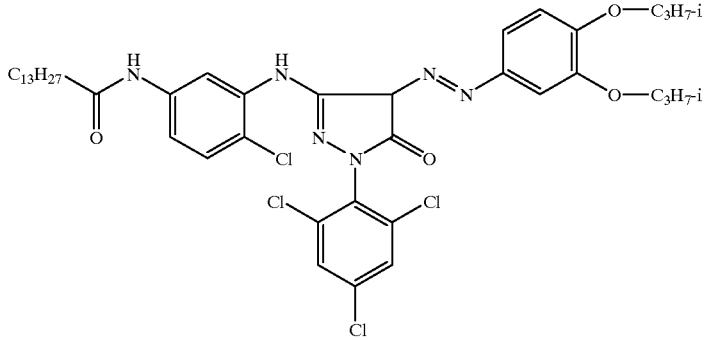
MY-2
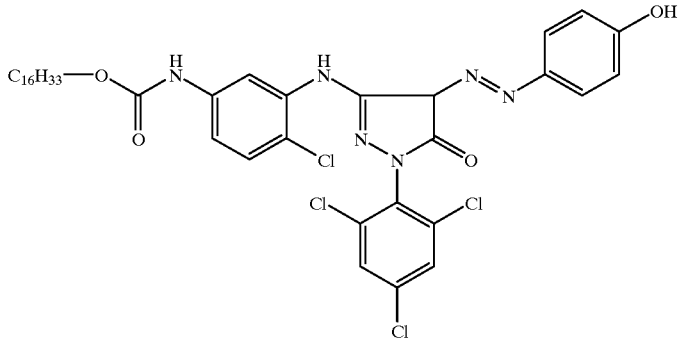

-continued
Y-1
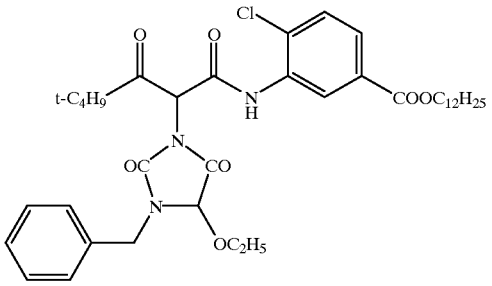
DIR-1
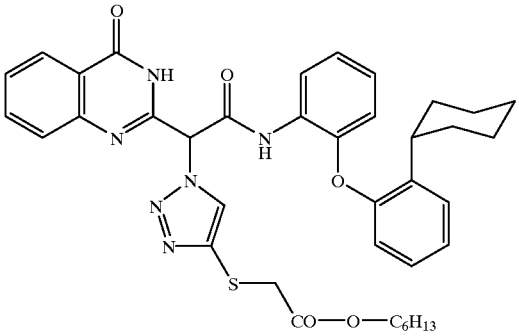
DIR-2
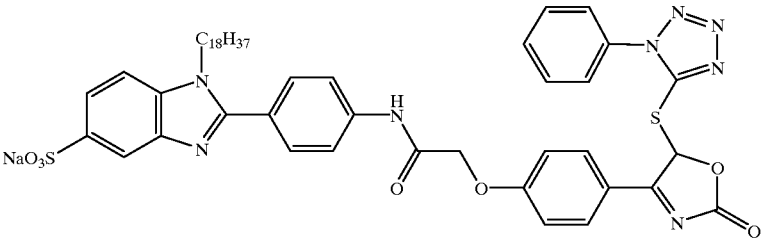
DIR-3
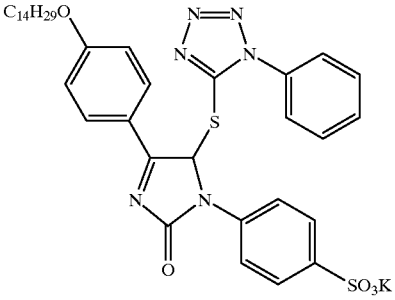
SC-1
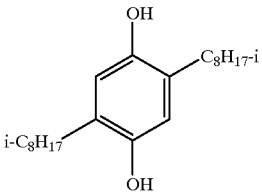
UV-1
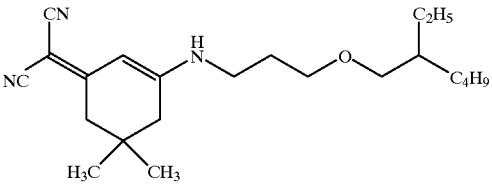

-continued

UV-2

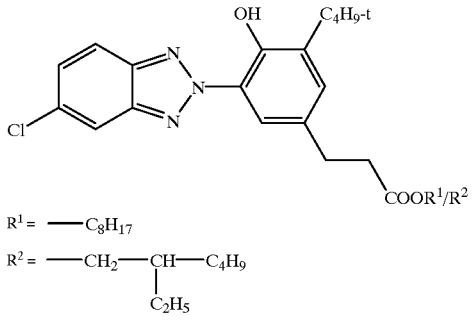

H-1

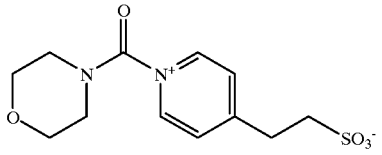

The colourless and chromatic couplers were each incorporated together with the same amount of tricresyl phosphate (TCP) by emulsification methods known in the art.

Sample 1.2

According to the Invention

Sample 1.2 differed from sample 1.1 in that in layer 4 it only contained 0.1 g of cyan coupler C-2, and that in layer 5 it additionally contained 0.1 g of cyan coupler.

Sample 1.3

Sample 1.3 (according to the invention) differed from sample 1.2 in that in layer 8 it contained the dye of formula

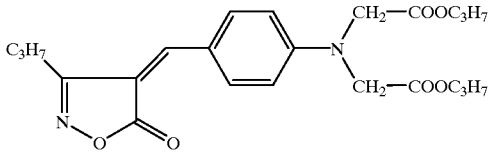

in an amount of 0.07 g/m$^2$, and the magenta coupler M-2 in an amount of 0.02 g/m$^2$, and in layer 9 it contained no yellow colloidal silver sol and no oxform scavenger SC-2 but additionally contained the magenta coupler M-2 in an amount of 0.03 g/m$^2$.

The samples were exposed to daylight behind a graduated neutral wedge filter, and were thereafter processed by the procedure described by E. Ch. Gehret, in the British Journal of Photography, 1974, page 597. Thereafter, the developed samples were stored for 3 weeks at 60° C. These samples exhibited no differences when examined afresh by sensitometry. The colour reproduction of the samples was determined in the following manner:

The Macbeth colour chart (Munsell Color, 2441 N. Calvert St., Baltimore, USA) was photographed and a neutrally matched print was produced from the negative. The quality of the colour reproduction was then compared visually. In the following description, A1 denotes the colour area in the top left corner of the colour chart, A6 denotes that in the top right-hand corner, B1–B6 describe the areas of the second row as seen from the top, and C1–C7 describe that of the third row which is adjacent to the row with the grey areas.

The following results were obtained:

1. After storage for 3 weeks in a heated cabinet, developed samples 1. and 1.2 exhibited an increase in the yellow minimum density by 0.12 density units; the yellow minimum density of sample 1.3 had only increased by 0.03 units, however.
2. For sample 1.2 according to the invention, the two areas B5 and C4 exhibited a colour shade which was considerably truer to the original than was that of sample A. Sample 1.3, which is particularly preferred according to the invention, verified the advantages of sample 1.2 as regards areas B5 and C4; in addition it exhibited a considerably better, namely greener, reproduction of the turquoise area A6, the reproduction of which was much too blue in samples A and B. Thus the correction of the reproduction, which was too red, of B5 and B4, was surprisingly and advantageously successful for the reproduction of other colour shades.

The following values were obtained in the CIELAB system (R. G. W. Hunt, The Reproduction of Colour, Fountain Press, Talworth 1987) for the colour hue deviation ΔH compared with the original:

| Color field | Sample A | Sample B | Sample C |
|---|---|---|---|
| B5 | −22 | −12 | −12 |
| C4 | −11 | −4 | −4 |
| A6 | +9 | +9 | +3 |

We claim:

1. A color silver halide material which comprises at least two red-sensitive, cyan-coupling silver halide emulsion layers of different photographic sensitivity, at least two green-sensitive, magenta-coupling silver halide emulsion layers of different photographic sensitivity and at least one blue-sensitive, yellow-coupling silver halide emulsion layer, and having intermediate layers at least between silver halide emulsion layers of different color sensitivity, wherein at least one color coupler is provided in a silver halide-free intermediate layer which is directly adjacent to a lowest-sensitivity silver halide emulsion layer which is sensitive to a defined spectral region, which color coupler couples in a non-complementary manner with respect to the aforementioned lowest-sensitivity silver halide emulsion layer.

2. The color photographic silver halide material according to claim 1, wherein said silver halide-free layer which is directly adjacent to the highest-sensitivity red-sensitive layer and which is directly adjacent to the lowest-sensitivity green-sensitive layer contains at least one cyan coupler.

3. The color photographic silver halide material according to claim 1, wherein said silver halide-free layer which is directly adjacent to the highest-sensitivity green-sensitive layer and which is directly adjacent to the lowest-sensitivity blue-sensitive layer contains at least one magenta coupler.

4. The color photographic silver halide material according to claim 1, wherein the coupler is used in the intermediate layer in an amount from $10^{-5}$ to $5.10^{-4}$ mmoles/$m^2$.

5. The color photographic silver halide material according to claim 1, wherein the highest-sensitivity green-sensitive layer contains at least one yellow organic dye which is decolorized or removed by the processing procedure.

6. The color photographic silver halide material according to claim 1, wherein the light-insensitive layer between the highest-sensitivity green-sensitive layer and the lowest-sensitivity blue-sensitive layer contains a yellow tinted color coupler which forms a magenta dye with the oxidation product of a color developer.

7. The color photographic silver halide material according to claim 5, wherein at least one yellow organic dye in the highest-sensitivity green-sensitive layer produces at least 80% of the yellow density of the layers of the material before processing.

8. The color photographic silver halide material according to claim 2, wherein said cyan coupler is naphtholic cyan coupler.

9. The color photographic silver halide material according to claim 3, wherein said magenta coupler is a 2-equivalent pyrazolone magenta coupler.

10. The color photographic silver halide material according to claim 5, wherein said at least one yellow organic dye is of the formula (I) or (II)

(I)

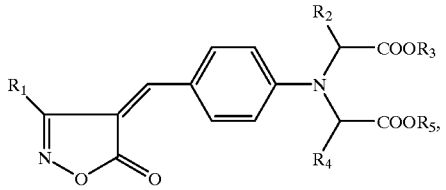

(II)

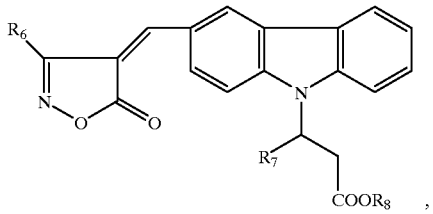

wherein $R_1$, $R_3$, $R_5$, $R_6$ and $R_8$, independently of each other, represent alkyl, cycloalkyl or aryl, and $R_2$, $R_4$ and $R_7$, independently of each other, represent hydrogen or alkyl.

11. The color photographic silver halide material according to claim 1, wherein a yellow filter layer is provided between the green-sensitive and blue-sensitive layers and prevents blue light from reaching the layers underneath.

* * * * *